United States Patent [19]

Vits

[11] 4,320,587

[45] Mar. 23, 1982

[54] DRYER FOR A CONTINUOUSLY TRAVELING WEB

[76] Inventor: Hilmar Vits, Hüschelrath 16, D-5672 Leichlingen, Fed. Rep. of Germany

[21] Appl. No.: 126,344

[22] Filed: Mar. 3, 1980

[30] Foreign Application Priority Data

Mar. 3, 1979 [DE] Fed. Rep. of Germany ..... 2908348

[51] Int. Cl.[3] ..... F26B 17/10

[52] U.S. Cl. ..... 34/156; 226/97

[58] Field of Search ..... 226/7, 97; 34/155, 156

[56] References Cited

U.S. PATENT DOCUMENTS

| | | | |
|---|---|---|---|
| 3,199,224 | 8/1965 | Brown | 34/156 |
| 3,324,570 | 6/1967 | Flaith et al. | 34/156 |
| 3,739,491 | 6/1973 | Creapo et al. | 34/156 |

*Primary Examiner*—Larry I. Schwartz

*Attorney, Agent, or Firm*—Kenyon & Kenyon

[57] ABSTRACT

A dryer for a continuously traveling web is formed by an enclosure through which the web travels, and which is formed by upper and lower chambers which are vertically separable. At least one chamber has a series of jet boxes which pneumatically hold the web against deflection. A manifold for the boxes on the side of the series facing away from the web is laterally spaced from a side wall of the chamber. A blower is horizontally offset from the manifold and is positioned between the manifold and the side wall and a conduit interconnects the blower and manifold. The offset position of the blower relative to the manifold causes the two components to overlap each other, permitting them to have adequate vertical dimensions while reducing the height they would otherwise require.

7 Claims, 4 Drawing Figures

DRYER FOR A CONTINUOUSLY TRAVELING WEB

BACKGROUND OF THE INVENTION

Continuously traveling webs, as exemplified by freshly printed textile webs, are dried by being passed horizontally through a continuous dryer having an enclosure provided with an inlet and outlet for the web.

Inside of the enclosure and on one or both sides of the traveling web, a series of transverse laterally interspaced nozzle boxes is horizontally positioned so as to function to pneumatically float the web through the enclosure without the web surfaces being mechanically contacted. The jet boxes are supplied with pressurized air via one or more blowers.

The enclosure is preferably formed by upper and lower open-faced interfacing chambers which are vertically separable from each other to give access to the jet boxes and web when necessary.

This has complicated the construction of such dryers. One solution has been to provide a stationary external blower which supplies the nozzle boxes via flexible hoses permitting separation of the two chambers. To provide a more integrated construction, the necessary blower or blowers have been mounted externally on the two chambers. Various other expedients have been tried. Known dryers have been less than satisfactory in the direction of compactness and manufacturing costs.

DESCRIPTION OF THE INVENTION

According to the present invention, either the upper or lower chamber, or both, has a manifold on that side of the jet-box series which faces away from the travel path of the web, and is manifolded to the boxes, this manifold being laterally or horizontally spaced from a side wall of the chamber and extending at least to one end of the chamber where the manifold has an outlet for the necessary supply of pressurized air. This arrrangement leaves a space between the manifold and side wall. For the air supply a blower of the radial centrifugal type is horizontally offset from the manifold with the blower axis perpendicular to the manifold, and the blower is spaced from the side of the series of jet boxes facing away from the travel path of the web so as to be free from interference by the jet boxes. This blower is positioned in the space between the manifold and the chamber side wall, meaning the one adjacent to the manifold. Because the blower and the jet box manifold are horizontally offset from each other, they can be overlapped in the vertical direction, permitting either or both to be of larger vertical dimension than would otherwise be possible within the same height limits.

The blower has its tangential delivery or output outlet or opening positioned to face the chamber's end wall where the manifold's inlet is located and a conduit interconnects the outlet and inlet so that the blower's output via the manifold is supplied to the various jet boxes. Although the blower's output opening or outlet is offset horizontally from the jet box manifold, the interconnecting conduit can be formed as a gentle S-curve which does not seriously impede the air flow from the blower to the manifold. Although the manifold which overlaps the blower may be at a different level, the interconnection between the conduit and the manifold's inlet may be via a vertical section having flow-guiding vanes maintaining the flow efficiency of the system.

Both chambers may be correspondingly designed so that the web is restrained against vertical movement in either direction, With a wide construction it is possible to provide the series of jet boxes with two transversely interspaced and mutually parallel manifolds with each manifold supplied with pressurized air via blowers respectively arranged on opposite side walls but as described before. In this case the blowers, being of the radial centrifugal type, may have their usual axial inlet openings axially aligned with each other transversely with respect to the chamber involved. Then, by providing shrouds around the two interfacing inlets and with the shrouds having openings in either the forward or rearward directions, or both, which receive the air from the enclosure, heat exchangers may be positioned in these openings for heating the air input of the blowers for delivery to the jet boxes.

Whether only one blower with its conduit and manifold system for a narrow series of jet boxes is used, or two blowers are used, as in the case of wider jet boxes, the components may be mounted by their respective upper or lower chambers. In other words, in any event, the series of jet boxes, the manifold for these boxes and the offset blower and the conduit interconnecting the blower's outlet with the inlet of the manifold may all be mounted by the upper or lower chamber as the case may be. Each chamber and its components form, in effect, an integrated, self-contained unit of very substantial compactness and, therefore, involving minimum manufacturing costs. In addition, both the upper and lower chambers can be constructed indentical with the other.

Normally, each manifold for the jet boxes is made with a large cross section or vertical dimension at its inlet end and tapers to its closed end feeding the last jet box of the series involved. Preferably the blower or blowers are mounted about midway between the ends of the chamber or chambers. Motors for the blowers can be mounted externally on the outside of the side wall of the chamber involved. With the blowers and their motors centrally located between the chamber ends, the chambers have a balanced construction. Each blower's housing can be tucked against the roof or bottom of the chamber, as the case may be, so as to just clear the jet boxes. Because the manifolds for the jet boxes are horizontally displaced relative to the blower housings, these manifolds may have adequate vertical extents considering that it is their midlengths that are opposite the blower housings, the overlapping or horizontal offset positioning of the two parts preventing one from interfering with the other.

The foregoing principles are schematically illustrated by the accompanying drawings which are described in detail hereinafter.

DETAILED DESCRIPTION OF THE DRAWINGS

Figure 1:
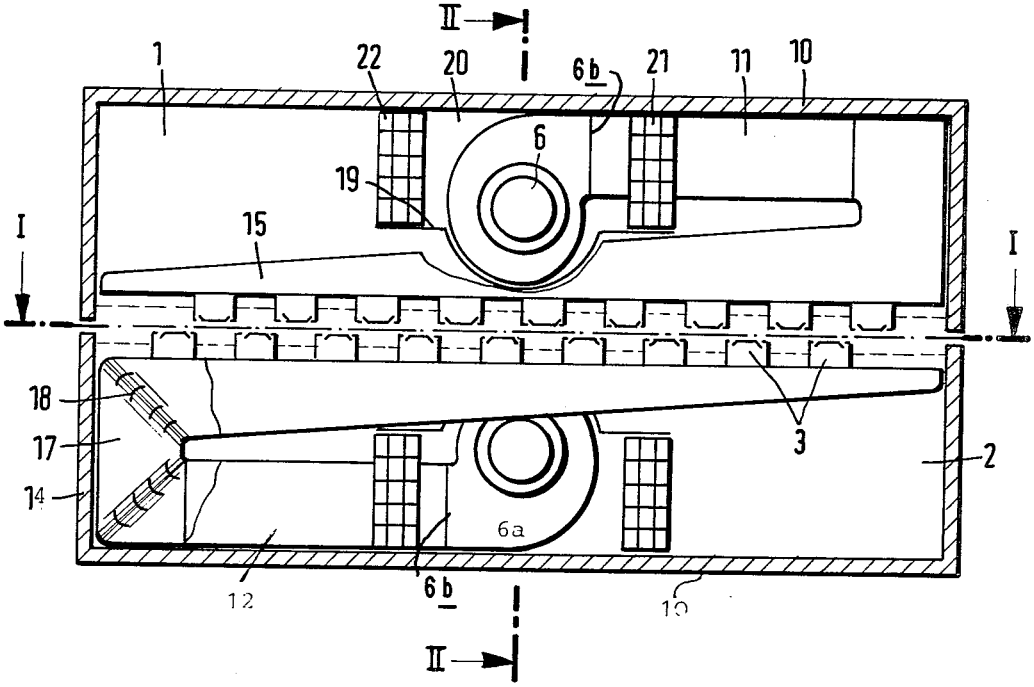
FIG. 1 is a vertical longitudinal section taken on the line III—III in FIG. 3.
Figure 2:
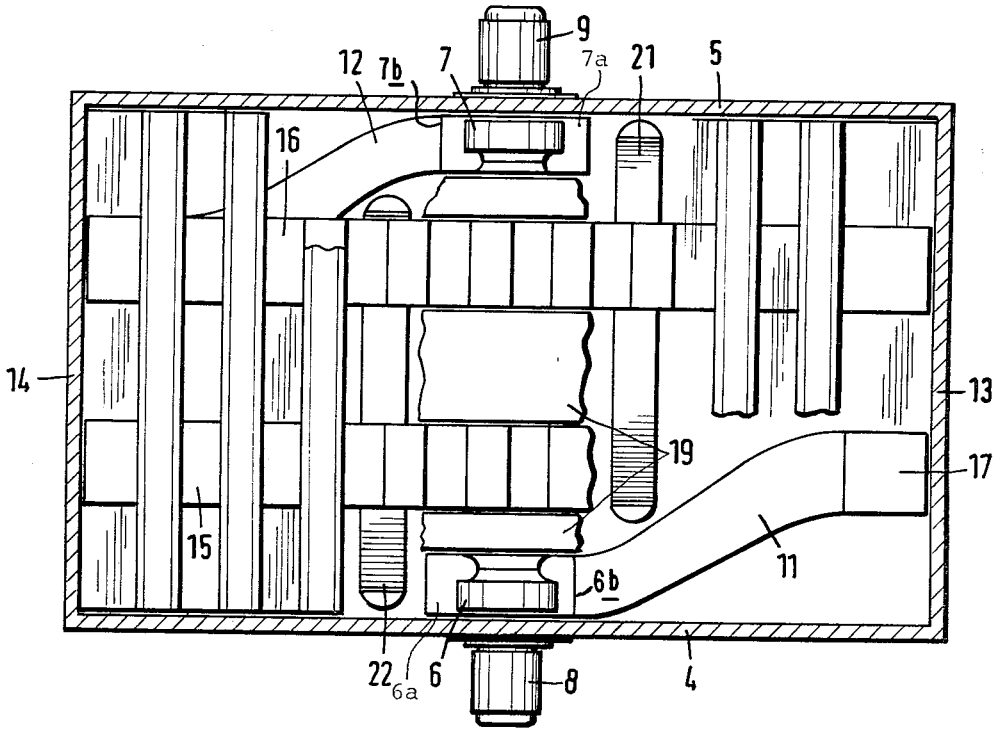
FIG. 2 is a horizontal section taken on the line I—I in FIG. 1.
Figure 3:
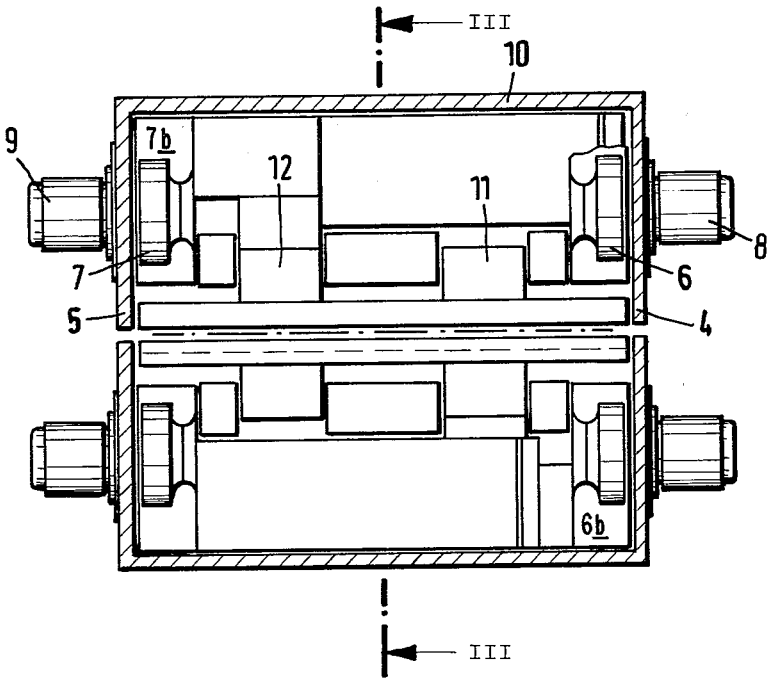
FIG. 3 is a cross section taken on the line II—II in FIG. 1.

Referring to FIGS. 1 and 2 in particular, the upper chamber 1 and the lower chamber 2 are shown with their open faces interfacing to form the enclosure, each chamber throughout its length mounting the series of jet boxes 3 with the boxes of each series being mutually parallel and interspaced and positioned transversely or at right angles to the web which passes between them, the web travel path coinciding with the cross section line I—I. These jets boxes are of the air-cushion-jet-assembly or hover type so as to float the traveling web (not shown) between them. The boxes of one series are offset between the boxes of the other series in the longitudinal direction of the web travel path.

The two chambers may be identically constructed, and because the lower chamber is specifically illustrated by both FIGS. 1 and 2, it is used to describe the construction of both chambers.

As shown by FIG. 2, this lower chamber 2 is rectangular, contains the series of jet boxes 3, and has side walls 4 and 5 which, intermediate their ends, mount the radial centrifugal blowers 6 and 7 with horizontal axes perpendicular to the side walls, the blowers being respectively powered by the external motors 8 and 9. As illustrated, the blower housings 6*a* and 7*a* are made with radial and therefore vertical dimensions extending from the cover or bottom 10 almost up to the bottom surfaces of the jet boxes 3, permitting blowers of maximum capacity to be used.

The outlets 6*b* and 7*b* of the housings of the blowers 6 and 7 respectively connect via the S-curved conduits 11 and 12, which extend to the end walls 13 and 14 of the opposite ends of the chamber.

As shown by FIG. 2, the series of jet boxes 3 mounted by this lower one of the chambers are provided with two of the manifolds 15 and 16, both which are manifolded to the various jet boxes to supply the latter with pressurized air.

The S-curved conduits 11 and 12 connect via vertical sections 17 respectively with the inlet ends of the manifolds 15 and 16, flow deflectors 18 serving to prevent undue turbulence at the right angle bends involved.

As illustrated, the manifolds 15 and 16 in all cases taper in vertical height from their inlet ends to their closed ends, and as shown by FIG. 1, they and the blower housings would interfere with each other were it not for the offsetting of the two as previously described. This permits the blowers and their powering motors to be mounted centrally with respect to the length of the chamber.

This central positioning of the two blowers of each chamber with the blower axes horizontally and axially aligned with each other, permits the usual axial inlet openings of the blowers' housings to be aligned transversely in each instance with respect to the chamber. With this arrangement the inlets of each two opposite blowers can be segregated or separated from the balance of the chamber space by the use of shrouding or baffling, indicated at 19, shown broken away in FIG. 2, with the shrouding formed to provide inlet openings facing the end walls 13 and 14 in opposite directions. The air is drawn into these openings from opposite ends of the chamber, and by providing heat exchangers 21 and 22 at these openings, the air can be heated for recirculation via the jet boxes. As indicated by FIG. 2, the inlet openings of the shrouding can be oriented to permit the heat exchangers 21 and 22 to be offset from the S-curved conduit lengths 11 and 12, permitting large heat exchanging areas. The space enclosed by the shrouding of the upper chamber is indicated at 20 in FIG. 1.

Figure 4:
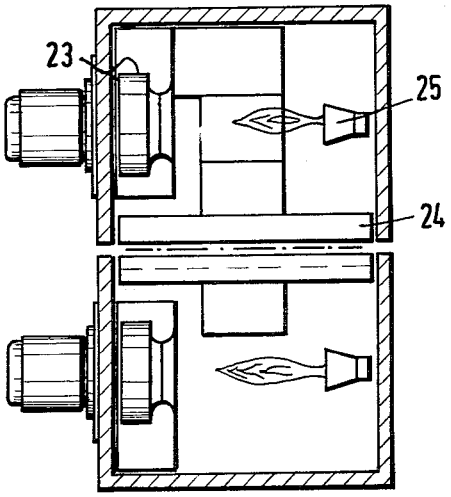
FIG. 4 is a cross section showing a modification.

FIG. 4 is provided mainly to show that in the case of narrow webs to be dried each series of jet boxes may be supplied via only one of the manifolds, the details being otherwise as described hereinabove.

Although not shown, it is to be understood that the two chambers can be hinged together along their longitudinal sides so that the enclosure can be opened for internal inspection by swinging open the two chambers, normally only the upper chamber.

It can be seen from the foregoing that with each chamber having the blowers of each, in effect, nested in each instance in the corner formed by the side wall and cover, or top or bottom wall as the case may be, each blower housing can have a diameter extending from that cover almost to the back sides of the jet boxes supplied by that blower. At the same time, the blower can deliver through adequately sized ducts, such as 11 and 12, which gently curve reversely to supply the inlet of the manifold involved, and which may itself taper from its end connected with the conduit to its closed end without restriction in its vertical height because in each case the manifold is offset so as to clear the blower housing. This permits each blower to deliver its output so the output in effect reverse and doubles back on itself to feed the jet boxes involved.

Furthermore, because each blower is nested in the corner formed by a vertical side wall and a horizontal wall formed by either the cover or bottom wall, each blower's housing 6*a* or 7*a* has its outlet 6*b* or 7*b* also positioned or arranged in that same corner and pointing towards the chamber's end wall towards which the blower's output is to be delivered via the appropriate one of the s-curved conduits. This positions the start of the s-curved conduit in the corner, but the deviation or curving of the conduit causes the conduit to change in direction from the side wall towards the middle of the chamber and permits its other end to connect with the inlet end of the connected manifold via its vertical connection 17.

In FIG. 4, the blowers are shown at 23, the jet boxes at 24, and for heating, gas jets 25 are illustrated.

What is claimed is:

1. A dryer for a continuously traveling web and comprising an enclosure having an entrance and exit through which the web travels in a substantially horizontal path through the enclosure, the enclosure being formed by upper and lower open-faced interfacing chambers which are vertically separable so as to permit access to said path, each chamber having vertical side and end walls and a horizontal wall opposite to the chamber's open face, at least one of said chambers containing a substantially horizontal series of jet boxes extending along said path so as to pneumatically hold the web against deflection towards the series, a manifold positioned horizontally at the side of said series facing away from said path and manifolded to said boxes, said manifold being horizontally spaced from one side wall of the chamber and extending at least to one end wall of the chamber and having an inlet at this one end wall, a radial centrifugal blower horizontally offset from said manifold vertically opposite to and spaced from said side of said series and positioned between the manifold and said side wall, the blower having a delivery outlet positioned in a corner formed by said side wall and the horizontal wall of said one of the chambers, said outlet facing said one end wall, and a conduit interconnecting the blower's said outlet and the manifold's said inlet, said conduit changing in its extending direction from said side wall towards the middle of the chamber to as to effect said interconnecting, the other of said chambers having means for pneumatically holding the web against deflection away from said series.

2. The dryer of claim 1 in which said manifold and blower have vertical dimensions causing them to overlap in the vertical direction.

3. The dryer of claim 2 in which said conduit curves reversely so as to interconnect the blower's said outlet and the manifold's said inlet.

4. The dryer of claim 1 in which said one chamber has a corresponding manifold, blower and conduit on the opposite side of the chamber and the two blowers have axially interfacing inlet openings axially interconnected by a shroud having horizontally oppositely facing side inlet openings.

5. The dryer of claim 4 in which heat exchangers are positioned in said side inlet openings.

6. The dryer of claims 1, 2, 3, 4 or 5 in which the other of said chambers corresponds to said one of the chambers.

7. The dryer of claim 1 in which said jet boxes extend transversely from one of said side walls to the other thereof and the side walls are spaced apart a width that is substantially the same as the width of said entrance and exit for the traveling web.

* * * * *